US005746011A

United States Patent [19]

Hedström

[11] Patent Number: 5,746,011

[45] Date of Patent: May 5, 1998

[54] ORTHOPEDIC INSOLE AND METHOD OF ITS MANUFACTURE

[75] Inventor: Peter J. Hedström, Umeå, Sweden

[73] Assignee: Ortolab AB, Stockholm, Sweden

[21] Appl. No.: 895,883

[22] Filed: Jul. 17, 1997

Related U.S. Application Data

[63] Continuation of Ser. No. 364,270, Dec. 27, 1994, abandoned.

[30] Foreign Application Priority Data

Oct. 24, 1994 [SE] Sweden ..... 9403647

[51] Int. Cl.[6] ..... A43B 13/40; A61F 5/14

[52] U.S. Cl. ..... 36/44; 36/174; 36/140

[58] Field of Search ..... 36/44, 80, 140, 36/166, 174

[56] References Cited

U.S. PATENT DOCUMENTS

| | | | |
|---|---|---|---|
| 975,576 | 11/1910 | Sexton | 36/140 X |
| 1,146,597 | 7/1915 | Scholl | 36/175 |
| 1,702,531 | 2/1929 | Ambill | 36/37 X |
| 1,843,952 | 2/1932 | McBrearty | 36/37 X |
| 2,979,835 | 4/1961 | Scholl | 36/44 |
| 4,633,598 | 1/1987 | Moronaga et al. | 36/44 |
| 4,782,605 | 11/1988 | Chapnick | 36/44 |
| 4,901,390 | 2/1990 | Daley | 36/44 X |
| 5,282,326 | 2/1994 | Schroer, Jr. et al. | 36/44 |

FOREIGN PATENT DOCUMENTS

| | | |
|---|---|---|
| 3527583 | 2/1987 | Germany . |

*Primary Examiner*—Ted Kavanaugh

*Attorney, Agent, or Firm*—Sughrue, Mion, Zinn, Macpeak & Seas, PLLC

[57] ABSTRACT

An orthopedic insert (2) includes a stiffening base part (4) and thereupon a shock-absorbing upper part (8) extending substantially over the entire insert (2). At least backwards from a point about ⅓ from the forward edge of it, the shock-absorbing upper part is substantially uniformly thick. The base part (4) is formed with an upstanding wall (6) round the heel portion thereof for keeping the heel cushion in place. On its underside the insert has regions (14, 16) with material removed under the longitudinal and forward arches of the user's foot. A method of manufacturing such an insert is also a subject of the invention.

6 Claims, 1 Drawing Sheet

ORTHOPEDIC INSOLE AND METHOD OF ITS MANUFACTURE

This is a continuation of application Ser. No. 08/364,270 filed Dec. 27, 994 now abandoned.

TECHNICAL FIELD

The invention relates in general to orthopedic insoles and in particular to such an article having improved shock-absorbing properties. The invention also relates to a method of manufacturing the inventive insole.

BACKGROUND ART

As more and more people take up sports, such as running, and with generally increasing interest in health, the need of orthopedic insoles or inserts in shoes increases, since they reduce the risk of injury, eg. when running, and also usually help to achieve better health. However, the implementation of such inserts is of the greatest importance, as a wrong insert is ineffective and may even be a health hazard.

Orthopedic shoe inserts are known, where a stiff material, such as ethyl vinyl acetate (EVA), is used to provide a stiffening function. The drawback with these inserts is that the material is selected either in a hard quality, causing discomfort to the user, or a soft quality, resulting in deteriorated stiffening function or total lack thereof.

Shock-absorbing material, such as HGP (high grade polymer) or the so-called Grete-Waitz insole have been used to achieve a shock-absorbing insole or insert. In the latter case, the above-mentioned stiffening function is not obtained.

The German patent specification DE-A1-35 27 583 (Stumf) discloses a shoe insole with a base having disposed on it shock-absorbing body giving a strong damping effect. In the heel region, where loading is greatest, the insole merely comprises the shock-absorbing body. In certain other places the body is thicker, to conform with the underside of the foot. Under the arch of the foot, for example, the insole is built up with a wedge of stiffer material.

This known shoe insole has several drawbacks. Inter alia, the uneven thickness of the shock-absorbing body results in greater damping in certain areas, which may result in lowered insole performance. In addition, the wedge of stiffer material causes the natural, lateral, rolling movement of the foot to be reduced or eliminated, resulting in that the shock-absorbing function of the foot itself is lessened, and this may lead to painfulness and wear injuries due to strain etc.

In the known insoles of the kind in question, heavy shock-absorbing material such as Sorbotan and Viscolas® are used, with the accompanying disadvantage that they become heavy and clumsy.

OBJECT OF THE INVENTION

An object of the present invention is to provide an orthopedic shoe insole or insert, which circumvents the above-mentioned drawbacks and which provides a better shock-absorbing function than other, known inserts.

Another object is to achieve an advantageous method of manufacturing such a shoe insert.

BRIEF ACCOUNT OF THE INVENTION

The above-mentioned objects are achieved by an orthopedic insert having a shape formed substantially to the sole of the user's foot. This insert includes a stiffening base part and thereupon a shock-absorbing upper part extending substantially over the entire insert, and is characterised in that the upper part at least backwards from a point about ⅓ from the forward edge thereof, is substantially uniformly thick.

Along its bottom the insert is preferably tapered in the region under the user's foot arch.

In accordance with another aspect of the invention a method is provided for manufacturing an insert, including making a plaster cast of an unstressed foot, allowing said cast to set, manufacturing a base of stiff material, which, by utilizing said plaster cast is in conformity with the sole of the foot, coating an upper part of shock-absorbing material with contact glue previous to applying it to the base part, characterised by pressing together the upper part and base part in an apparatus using vacuum technique, for the time the glue takes to set.

Remaining distinguishing features are disclosed in the sub-claims.

BRIEF DESCRIPTION OF DRAWINGS

The invention will now be described in more detail in the form of an example, and with reference to the accompanying drawing, where.

PREFERRED EMBODIMENT

An insert in accordance with the invention in a preferred embodiment will be described below, together with a preferred method of manufacturing such an insert.

Figure 1:
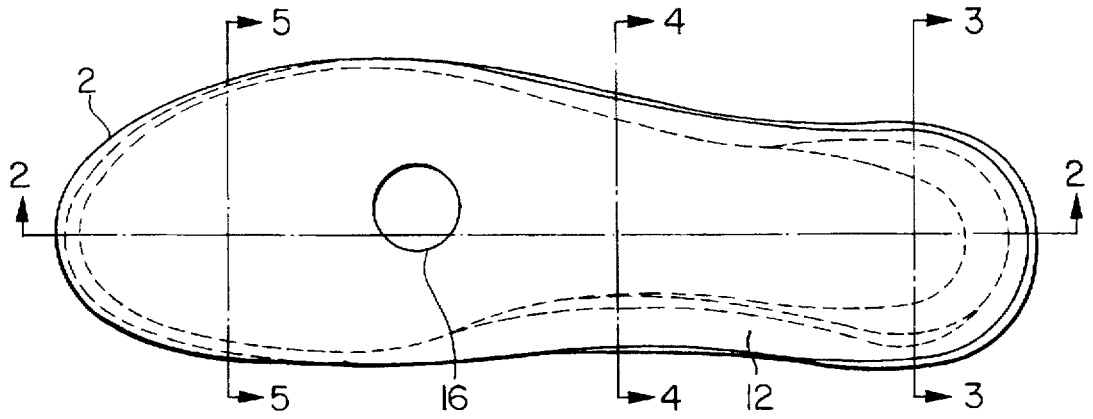
FIG. 1 is a view from above of the inventive insert.
Figure 2:
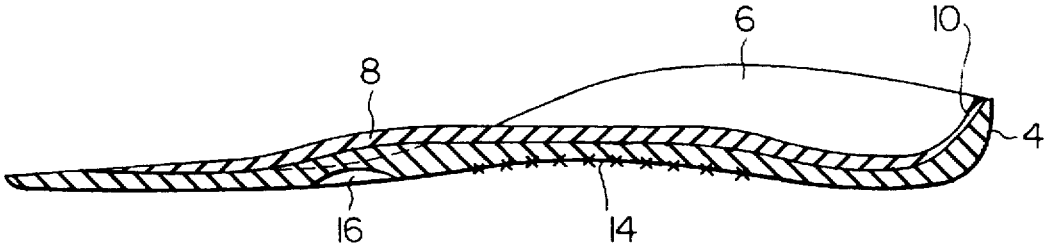
FIG. 2 is a section through the insert of FIG. 1 along the lines D—D.
Figure 3:
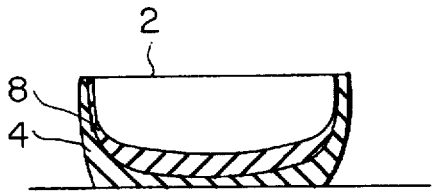
FIG. 3 is a cross section through the insert of FIG. 1 along the lines A—A.
Figure 4:
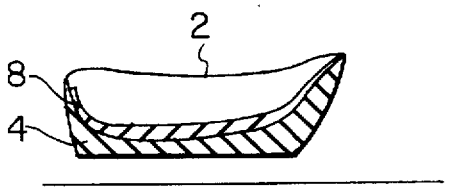
FIG. 4 is a cross section through the insert of FIG. 1 along the lines B—B.
Figure 5:
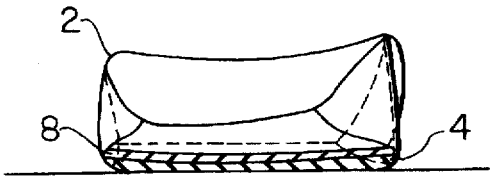
FIG. 5 is a cross section through the insert of FIG. 1 along the lines C—C.

As will be seen from FIG. 1, the inventive insert 2 has a shape fitting ordinary shoes. FIG. 2, which is a section through the insert in FIG. 1, illustrates how it is built up. The lower part or base 4 extends over the entire length of the insert and has a profile adjusted to the shape of the sole of the user's foot. The base 4 also includes an upstanding side wall 6 round its heel portion, giving this portion a basin-like configuration, which keeps the fat cushion under the heel together, thus increasing shock-absorbing capacity. The wall 6 has a height of 1–5 cm.

In the preferred embodiment the base 4 is made from ethyl vinyl acetate (EVA), which has been shaped to fit the foot sole.

On top of the base there is provided an upper part 8, of shock-absorbing material, eg. HGP or an insole marketed under the trade name "Grete Waitz Insole". Rearwards, starting at a point at least about ⅓ of the total length of the insert from the forward edge thereof and denoted by a dashed line in FIG. 1, the upper part has a substantially uniform thickness, preferably of about 6 mm.

On its underside, the upper part tapers off forwards from said point, starting at the dashed line indicated in FIG. 1 and situated at least about ⅓ of the total length of the insert from the forward edge thereof, to become about 2 mm at said forward edge, where the shock-absorbing requirement is less than that more rearwards. The insert is thus very thin at its forward portion, which enables its use in most shoes. The upper part is thus given its greatest thickness where loading is greatest, since there is not the same need to absorb shocks in the forward part of the foot.

Completing the orthopedic insert or insole, there is a covering 10 made from some tough material, eg. galloon or P.V.C. coated fabric, over the whole of the upper side of the insert, which prevents friction between foot and insert as well as increasing the life of the latter.

In FIG. 2 an arch 14 is denoted by crosses. In this region the insert is pared away on the medial or inner side of the insert in the area 12 in FIG. 1. By this implementation the foot can yield in the longitudinal arch, so that the natural shock-absorbing action of the foot is maintained. For practical reasons, also the outer side of the insert can be pared away in this area.

Also, there is a recess or depression pared away from under the bottom part of base 4 in the area 16 under the forward or transverse (metatarsal) arch. The recess, which is essentially circular, has a diameter of about 2 cm, but can have a diameter in the range from 1–4 cm, depending on the size of the insole, the weight of the user etc. The function of this recess is to allow a "pad" or a support for the transverse arch on the upper side of the insole above the recess 16 to give away when pressure is put on the forward part of the foot, thus avoiding discomfort and possible injury to the user. This support usually has a diameter of about twice the diameter of the recess 16.

A preferred method of manufacturing the inventive insert will now be described below.

A plaster cast of the foot is made to begin with, the prospective user lying down during this procedure to ensure that the foot is not stressed. The cast is subsequently removed and allowed to set hard. There is thus obtained a mould corresponding to the sole of the foot.

The mould is then utilised to manufacture the base 4 of the insert and in the preferred embodiment the latter comprises ethyl vinyl acetate. This material may be obtained in different densities, and one of 55 durameters is suitable in this case. It is heated to make it soft, and then pressed against the mould to provide the base 4, which is subsequently tapered off at the medial or inner side such as to correspond to the arch of a foot, thus obtaining its final shape.

The upper part 8 has the general configuration of an insole, and is about 6 mm thick to start with. From a distance of about ⅓ of the length of the part away from its forward end it is tapered down towards this end to a thickness of about 2 mm. The part is then coated with contact glue, applied to the base and pinned in place.

The combination of upper part 8 and base 4 is now placed in an apparatus using vacuum to press the upper part against the base, and left there for some minutes. This affords a very tight joint between the two parts, and accordingly there is obtained an insert that has an upper side conforming to the foot sole, even with the upper part added.

The insert 2 is finally dressed, this process including the removal of an arch 14 on the medial or inner side of it, corresponding to the arch of the foot, as well as adjusting its shape to the shoe or shoes with which it is to be used. Preferably a protective material 10 such as galloon or PVC coated fabric is glued on top of the upper part 8.

The manufacturing method in accordance with the invention thus ensures a pliable insert, since the latter is tapered and consequently thinner.

Only a preferred embodiment of the invention has been described above, and it can have further variants within the scope of the claims. For example, the entire upper part 8 can have an uniform thickness.

I claim:

1. An orthopedic insole (2) having a shape configured to substantially correspond to the shape of a sole of an individual user's foot, said insole including a resilient and yet stiffening lower base part (4), and a shock-absorbing upper part (8) disposed on top of the base part and extending substantially over the entire surface thereof, wherein an essentially circular recess (16) having a diameter of about 1–4 cm is defined in an underside of the base part, approximately midway between opposite sides thereof, at a position lying under a forward arch of the user's foot, said recess enabling a portion of the upper part of the insole overlying the recess and an adjacent portion of the base part overlying the recess, to resiliently give way when pressure is applied thereto by a forward part of the user's foot.

2. An insole as claimed in claim 1, wherein the base part has an arched shape downwardly in a region (12) under a longitudinal arch of the user's foot.

3. An insole as claimed in claim 1, wherein a thickness of the upper part (8) decreases forwardly from a point about ⅓ from a forward edge thereof.

4. An insole as claimed in claim 1, wherein the base part includes an upstanding wall (6) around a heel portion of the insole.

5. An insole as claimed in claim 1, wherein the upper part is made from a high grade polymer.

6. An insole as claimed in claim 1, wherein backwards from a point about ⅓ from a forward edge thereof said upper part has a thickness of about 6 mm.

* * * * *